US006252349B1

(12) United States Patent
Inoue et al.

(10) Patent No.: US 6,252,349 B1
(45) Date of Patent: Jun. 26, 2001

(54) IMAGE DISPLAY DEVICE HAVING A CATHODE BOARD HELD BETWEEN FRONT AND BACK DISPLAY CASES

(75) Inventors: Akira Inoue; Yasuo Iwasaki, both of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/289,586

(22) Filed: Apr. 12, 1999

(30) Foreign Application Priority Data

Oct. 27, 1998 (JP) ..... 10-305138

(51) Int. Cl.[7] ..... H01J 1/62; H01J 63/04

(52) U.S. Cl. ..... 313/497; 313/493; 313/495; 313/496

(58) Field of Search ..... 313/497, 496, 313/495, 493

(56) References Cited

U.S. PATENT DOCUMENTS

| | | | | |
|---|---|---|---|---|
| 4,401,982 | * | 8/1983 | Miyazaki et al. | 345/47 |
| 4,831,307 | * | 5/1989 | Takenaka et al. | 313/478 |
| 5,532,545 | * | 7/1996 | Okamoto et al. | 313/407 |
| 5,536,995 | * | 7/1996 | Sugawara et al. | 313/477 R |
| 6,133,686 | | 10/2000 | Inoue et al. | 313/477 R |

FOREIGN PATENT DOCUMENTS

| | | | | |
|---|---|---|---|---|
| 60-101844 | | 6/1985 | (JP) . | |
| 60-105144 | | 6/1985 | (JP) . | |
| 62-52836 | | 3/1987 | (JP) . | |
| 2148544 | | 6/1990 | (JP) . | |
| 4349333 | | 12/1992 | (JP) . | |
| 5114372 | | 5/1993 | (JP) . | |
| 6119889 | | 4/1994 | (JP) . | |
| 6260090 | | 9/1994 | (JP) . | |
| 6267424 | | 9/1994 | (JP) . | |
| 06260090A | * | 9/1994 | (JP) | 9/40 |
| 7130308 | | 5/1995 | (JP) . | |
| 7142012 | | 6/1995 | (JP) . | |
| 10214564 | | 8/1998 | (JP) . | |

* cited by examiner

*Primary Examiner*—Vip Patel
*Assistant Examiner*—Kevin Quarterman

(57) ABSTRACT

An image display device has a front case provided with a phosphor screen on an inner surface thereof; a rear case facing the front case; a sealing portion with which the front case and the rear case are hermetically sealed so that an airtight chamber is formed between the inner surface of the front case and an inner surface of the rear case; and a cathode board including a cathode which is disposed within the airtight chamber and faces the phosphor screen and a wiring pattern for applying a voltage to the cathode. The the cathode board is held between the front case and the rear case by the sealing portion so that the cathode board is not in contact with the inner surface of the front case and the inner surface of the rear case.

14 Claims, 11 Drawing Sheets

| GLASS MATERIALS | TRANSMITTANCE %(10.16mm, 546nm) |
|---|---|
| A | 90 |
| B | 86 |
| C | 80 |
| D | 73 |
| E | 57 |
| F | 46 |

IMAGE DISPLAY DEVICE HAVING A CATHODE BOARD HELD BETWEEN FRONT AND BACK DISPLAY CASES

BACKGROUND OF THE INVENTION

The present invention relates to a flat image display device in which electrons emitted from a plurality of cathodes disposed on a cathode board impinge on a phosphor screen coated on an inner surface of a front glass case to display an image.

FIG. 12 is a cross-sectional view schematically showing a conventional flat image display device. As shown in FIG. 12, the conventional image display device comprises a front glass case 31 having a phosphor screen 32 on an inner surface thereof and a rear case 33. The front glass case 31 and the rear case 33 are hermetically sealed by frit glass at a sealing portion 35. Within an airtight chamber 34 are provided a cathode board 36 having cathodes facing the phosphor screen 32 for emitting electrons and a collector electrode 37 for collecting electrons emitted from the cathodes. As shown in FIG. 12, the cathode board 36 is supported by a plurality of support columns 38 fixed to the inner surface of the rear case 33 to face the phosphor screen 32.

FIG. 13 is an enlarged cross sectional view schematically showing a broken line part 40 of FIG. 12. In FIG. 13, a reference numeral 41 denotes a cathode (for instance, a conical cathode) for emitting electrons. A plurality of cathodes are orderly arranged in matrix form and corresponds to phosphor dots composing the phosphor surface 32. In FIG. 13, a reference numeral 42 denotes a cathode electrode for applying a voltage to the cathodes 41, a reference numeral 43 denotes an insulating layer, and a reference numeral 44 denotes a gate electrode.

In the above-described image display device, the electrons are emitted from the desired cathodes 41 when a predetermined negative voltage is applied to the cathode electrode 42 and a predetermined positive voltage is applied to the gate electrode 44. The emitted electrons are converged by electrostatic lens effect of the penetrating hole 37*a* formed in the collector electrode 37, and impinge on a metal back layer (not shown) provided on the phosphor surface 32 and to which a high voltage (e.g., +10 kV) is applied. As a result, the phosphor dots of the phosphor screen 32 emit light to form an image.

However, in the above-described conventional image display device, since the cathode board 36 is supported by the support columns 38 fixed to the rear case 33, a deformation or inward warp of the rear case 33 occurring after ejection of gas from the airtight chamber 34 causes a deformation or warp of the cathode board 36 toward the phosphor screen 32. As a result, a positional relationship between the cathodes 41 of the cathode board 36 and the phosphor dots of the phosphor screen 32 is changed, so the electrons emitted from the cathode electrodes 41 cannot impinge on the adequate phosphor dots, making it impossible to form an image of high quality.

Further, in the above-described conventional image display device, wiring of the lead lines 39 for applying the drive voltage to the cathodes 41 of the cathode board 36 is performed so that the lead lines 39 extend from the cathode board 36 through the sealing portion 35 to outside the case, while maintaining the insulating performance between the respective lead lines. This makes assembling the image display device very difficult.

Furthermore, in the above-described conventional image display device, since the outer and inner surfaces of the face portion 31*a* of the frond glass case 31 are flat, the face portion must be made thick in order to resist external atmospheric pressure. This, however, has caused a problem that an image is perceived as being floated near the edges of the face portion 31*a* and a displayed image is perceived concavely.

SUMMARY OF THE INVENTION

It is an object of the present invention to provide an image display device that can prevent image deterioration due to a deformation of the rear case and that can be made by simplified process.

It is another object of the present invention to provide an image display device that can display an image which is perceived as being flat.

According to the present invention, an image display device comprises: a front case having with a phosphor screen on an inner surface thereof; a rear case facing the front case; a sealing portion with which the front case and the rear case are hermetically sealed so that an airtight chamber is formed between the inner surface of the front case and an inner surface of the rear case; and a cathode board including a cathode which is disposed within the airtight chamber and faces the phosphor screen, and a wiring pattern for applying a voltage to the cathode; wherein the cathode board is held between the front case and the rear case by the sealing portion so that the cathode board is not in contact with the inner surface of the front case and the inner surface of the rear case.

Further, the face portion of the front case may include a substantially flat outer surface facing a viewer and the inner surface on which the phosphor screen is coated; and the inner surface of the face portion may be concavely curved with a radius of curvature $R_x$ in a horizontal direction parallel to a side of the face portion. In this arrangement, the following conditions (1), (2) and (3) are satisfied:

$$R_x \leq \frac{\left(\frac{W}{2}\right)^2 + \Delta t^2}{2 * \Delta t} \tag{1}$$

$$\Delta t = t * \left[1 - \frac{\cos^2\theta_2}{n_1 - \frac{1}{n_1} * \sin^2\theta_2}\right] \tag{2}$$

$$\theta_2 = \tan^{-1}\left(\frac{W}{2 * L}\right) \tag{3}$$

where W denotes a horizontal width of an effective picture area in the face portion, L denotes an optimum viewing distance, $n_1$ denotes a refractive index of the face portion, and t denotes a thickness of the face portion at a center thereof.

BRIEF DESCRIPTION OF THE DRAWINGS

The present invention will become more fully understood from the detailed description given hereinbelow and the accompanying drawings which are given by way of illustration only, and wherein.

DETAILED DESCRIPTION OF THE INVENTION

Further scope of applicability of the present invention will become apparent from the detailed description given hereinafter. However, it should be understood that the detailed description and specific examples, while indicating preferred embodiments of the invention, are given by way of illustration only, since various changes and modifications will become apparent to those skilled in the art from the detailed description.

First Embodiment

Figure 1A:
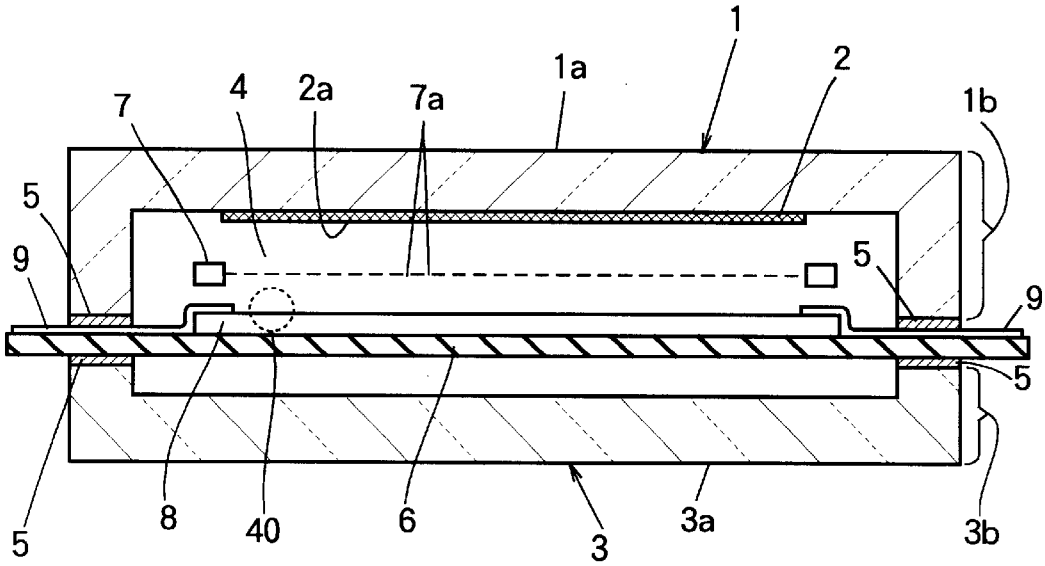
FIGS. 1A and 1B are respectively cross sectional and plan views of an image display device according to a first embodiment of the present invention.
Figure 1B:
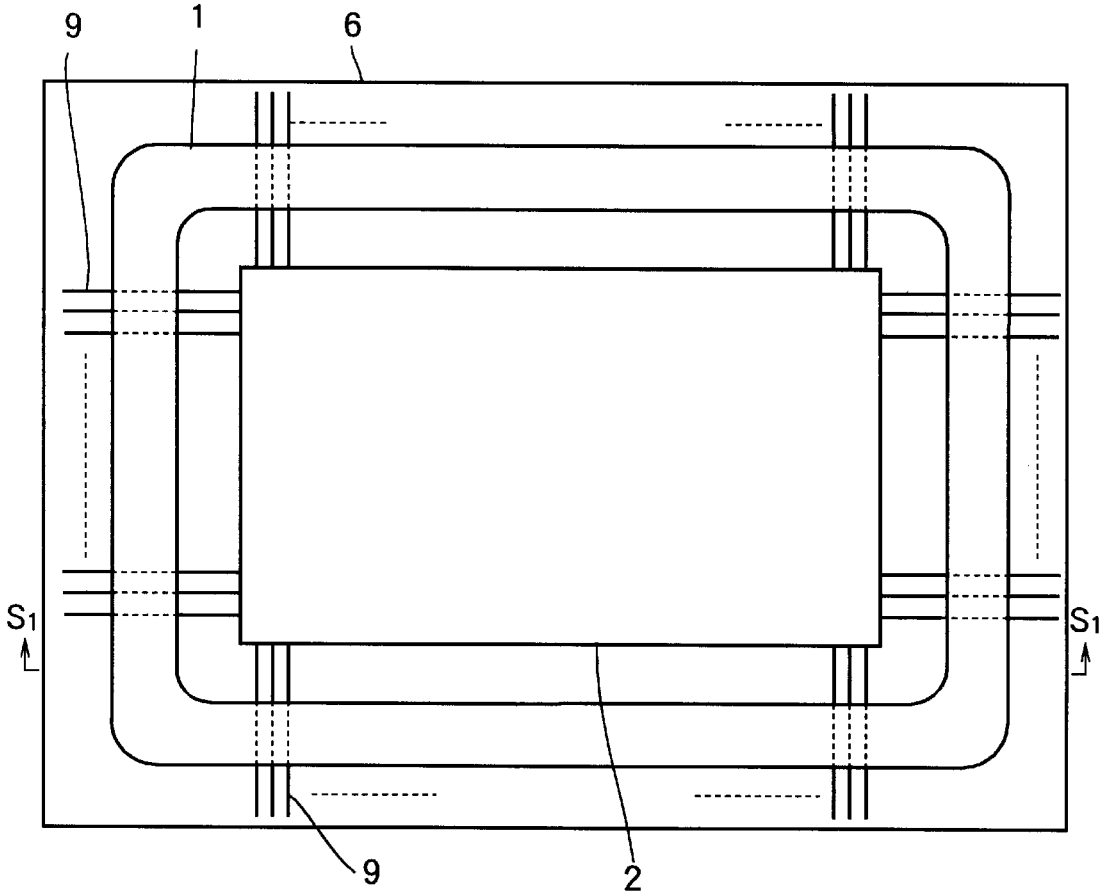

FIGS. 1A and 1B are respectively cross section and plan views schematically showing an image display device according to a first embodiment of the present invention. The cross section shown in FIG. 1A corresponds to the cross section taken along a line $S_1$—$S_1$ in FIG. 1B.

As shown in FIGS. 1A and 1B, the image display device of the first embodiment has a front glass case 1 provided with a phosphor screen 2 on an inner surface thereof, a rear case 3 facing the front glass case 1, and a sealing portion 5 with which the front glass case 1 and the rear case 3 are hermetically sealed so that an airtight chamber 4 is formed between the inner surface of the front glass case 1 and an inner surface of the rear case 3. The front glass case 1 includes a face portion 1*a* on which the phosphor screen 2 is provided and a side wall 1*b* extending from the face portion 1*a* toward the rear case 3. The rear case 3 includes a rear portion 3*a* and a side wall 3*b* extending from the rear portion 3*a* toward the front glass case 1. The sealing portion 5 is formed between the side wall 1*b* of the front glass case 1 and the side wall 3*b* of the rear case 3, for example, by frit glass.

Figure 13:
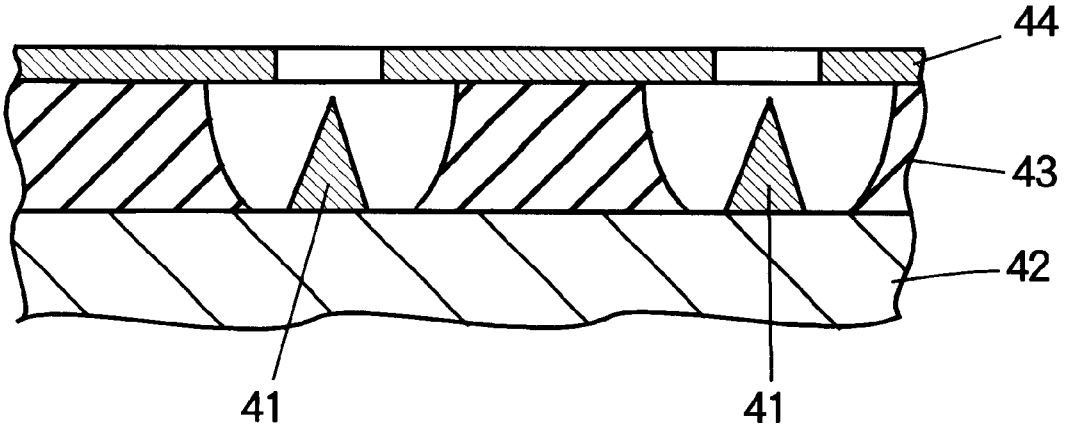
FIG. 13 CONVENTIONAL ART
FIG. 13 is an enlarged cross sectional view of broken line parts of FIG. 1A and FIG. 12.

Further, the image display device of the first embodiment has a cathode board 6 facing the phosphor screen 2 within the airtight chamber 4 and a collector electrode 7 provided between the cathode board 6 and the phosphor screen 2. The collector electrode 7 has a function of collecting electrons emitted from the cathodes. The collector electrode 7 is supported on the front glass case 1 or the cathode board 6, for instance. A cathode portion 8 of the cathode board 6 includes a plurality of cathodes 41 (show in FIG. 13) facing the phosphor screen 2 for emitting electrons and a wiring pattern 9 for applying a voltage to the cathodes 41. The cathode 41 is, for instance, conical as shown in FIG. 13, and electron emitting is controlled by voltages of the cathode 41 and the gate electrode 44. A plurality of cathodes 41 are arranged in matrix form and corresponds to the phosphor dots composing the phosphor screen 2. The phosphor dots of each color R, G or B are arranged in matrix of 480 rows and 640 columns, for instance.

In the above-described image display device of the first embodiment, electrons are emitted from the cathode 41 when a given negative voltage is applied to the cathode 41 and a given positive voltage is applied to the gate electrode 44. The emitted electrons are collected by electrostatic effect of the penetrating holes 7*a* of the collector electrode 7, and accelerated by high voltage (for instance, 10 kV) applied to the metal back layer 2*a* provided on an inner surface of the phosphor screen 2 on the side of the cathode board 6. The accelerated electrons with high energy strikes the phosphor dots of the phosphor screen 2, causing the phosphor dots to emit light so that an image is displayed on the phosphor screen 2.

As described above, in the image display device of the first embodiment, since the cathode board 6 is not supported on the rear portion 3*a* of the rear case 3 and is held on the sealing portion 5 between the side wall 1*b* of the front glass case 1 and the side wall 3*b* of the rear case 3, a deformation or inward warp of the rear portion 3*a* of the rear case 3 occurring after ejection of gas from the airtight chamber 4 does not cause a deformation or warp of the cathode board 6. As a result, a positional relationship between the cathodes 41 of the cathode board 6 and the phosphor dots of the phosphor screen 2 is not changed, so the electrons emitted from the cathodes 41 impinge on the adequate phosphor dots, making it possible to form an image of high quality.

Further, since both the wiring pattern 9 for applying the drive voltage to the cathodes 41 of the cathode portion 8 and the cathode board 6 extend from the sealing portion 5 outwardly, the manufacturing process of the image display device can be simplified.

Second Embodiment

Figure 2A:
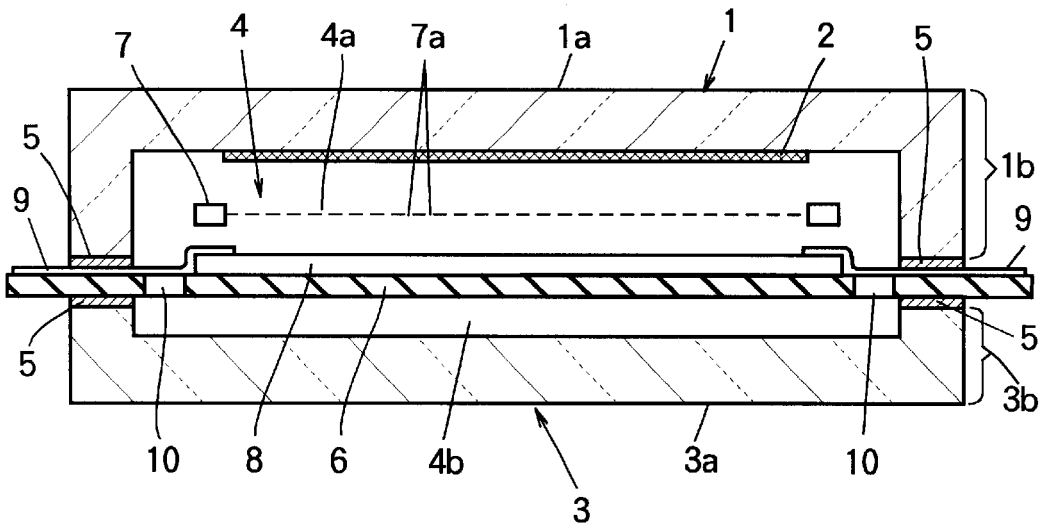
FIGS. 2A and 2B are respectively cross sectional and plan views of an image display device according to a second embodiment of the present invention.
Figure 2B:
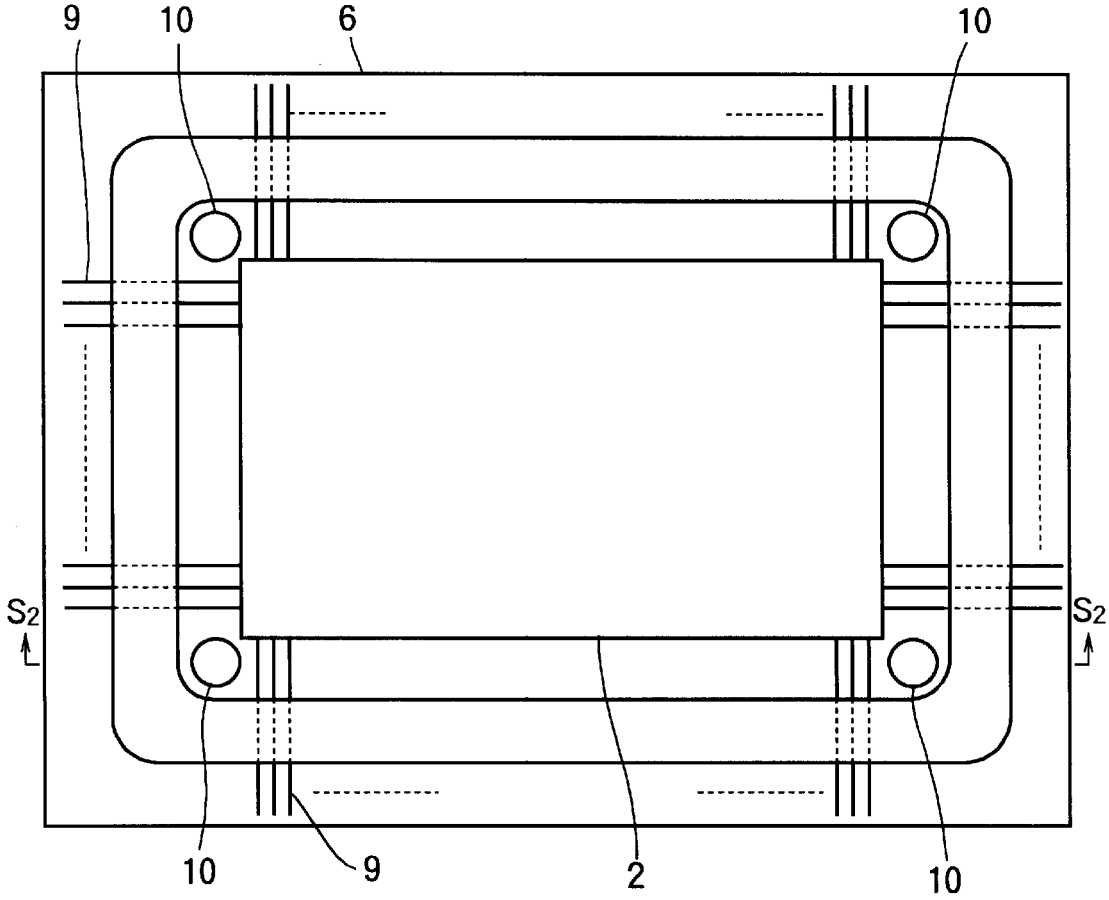

FIGS. 2A and 2B are respectively cross sectional and plan views schematically showing an image display device according to a second embodiment of the present invention. The cross section shown in FIG. 2A corresponds to the cross section taken along a line $S_2$—$S_2$ in FIG. 2B. Those structures in FIGS. 2A and 2B that are identical to or correspond to structures in FIGS. 1A and 1B are assigned identical symbols.

In the image display device of the second embodiment, the cathode board 6 has four through holes 10 through which a front chamber 4*a* formed between the front glass case 1 and the cathode board 6 communicates with the rear chamber 4*b* formed between the rear case 3 and the cathode board 6. Since the front chamber 4*a* of the airtight chamber 4 communicates with the rear chamber 4*b* of the airtight chamber 4, the airtight chamber 4 can be made vacuum using an exhaust pipe penetrating either the front glass case 1 or the rear case 3. Except for the above points, the second embodiment is the same as the first embodiment.

Third Embodiment

Figure 3A:
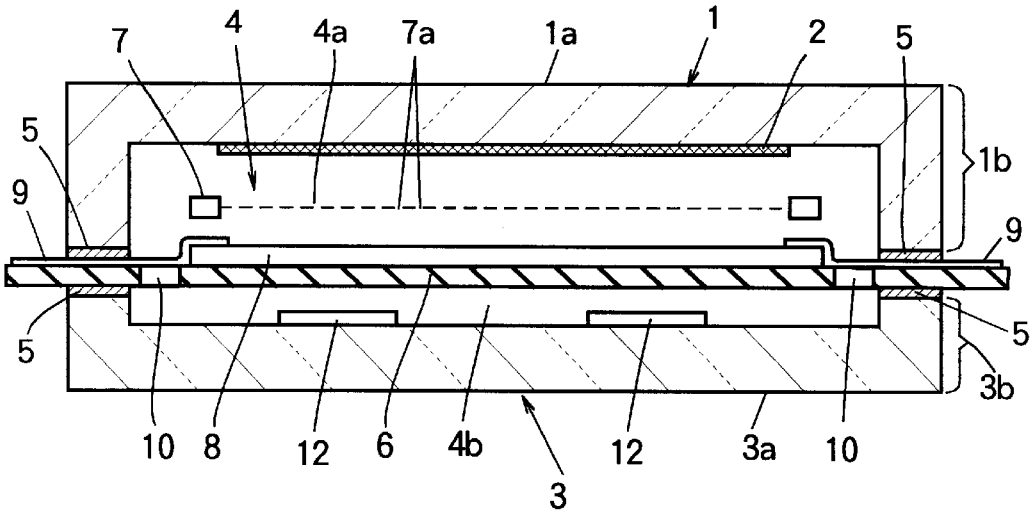
FIGS. 3A and 3B are respectively cross sectional and plan views of an image display device according to a third embodiment of the present invention.
Figure 3B:
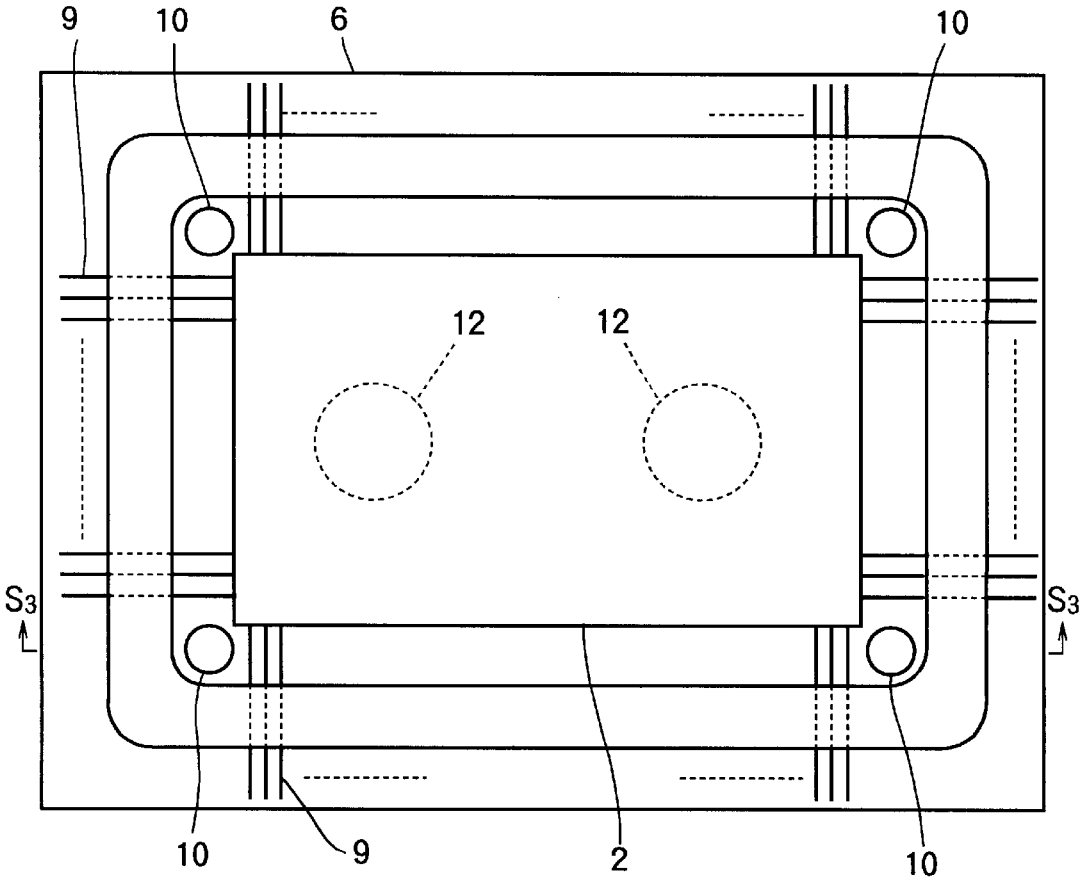

FIGS. 3A and 3B are respectively cross sectional and plan views schematically showing an image display device according to a third embodiment of the present invention. The cross section shown in FIG. 3A corresponds to the cross section taken along a line $S_3$—$S_3$ in FIG. 3B. Those structures in FIGS. 3A and 3B that are identical to or correspond to structures in FIGS. 2A and 2B are assigned identical symbols.

The image display device of the third embodiment is different from that of the second embodiment in that getters 12 for absorbing impurities to keep a high degree of vacuum are disposed within the rear chamber 4*b* on an inner surface of the rear case 3. Since the getters 12 are disposed in the rear chamber 4*b* on the side of the rear case 3, an outer surface of the getter 12 can be broad. Further, Since the getters 12 are disposed in the rear chamber 4*b* on the side of the rear case 3, deposition of material of the getters 12 to the cathode 41 (FIG. 13) can be prevented. Except for the above points, the third embodiment is the same as the second embodiment.

Fourth Embodiment

Figure 4A:
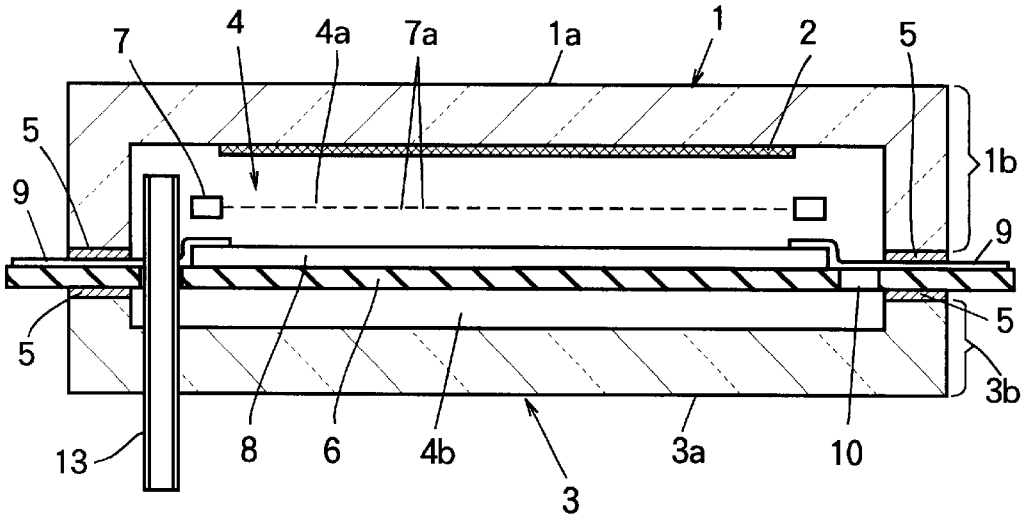
FIGS. 4A and 4B are respectively cross sectional and plan views of an image display device according to a fourth embodiment of the present invention.
Figure 4B:
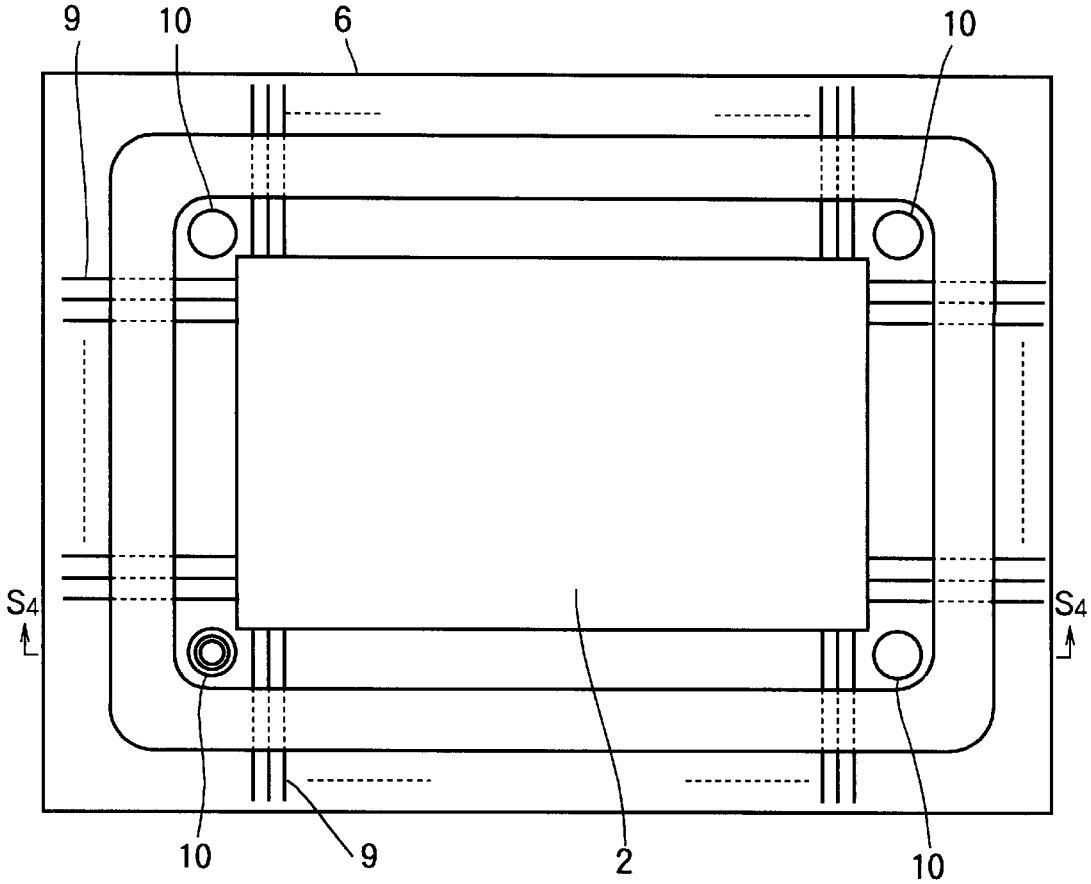

FIGS. 4A and 4B are respectively cross sectional and plan views schematically showing an image display device according to a fourth embodiment of the present invention. The cross section shown in FIG. 4A corresponds to the cross section taken along a line $S_4$—$S_4$ in FIG. 4B. Those structures in FIGS. 4A and 4B that are identical to or correspond to structures in FIGS. 2A and 2B are assigned identical symbols.

The image display device of the fourth embodiment is different from that of the second embodiment in that an exhaust pipe 13 for communicating the front chamber 4*a* between the front glass case 1 and the cathode board 6 and outside of the front glass case 1 and the rear case 3. Since the exhaust pipe 13 extends from the front chamber 4*a,* space around the cathodes 41 (FIG. 13) within the front chamber 4*a* can be kept to have a high degree of vacuum. Except for the above points, the fourth embodiment is the same as the second embodiment.

Fifth Embodiment

Figure 5A:
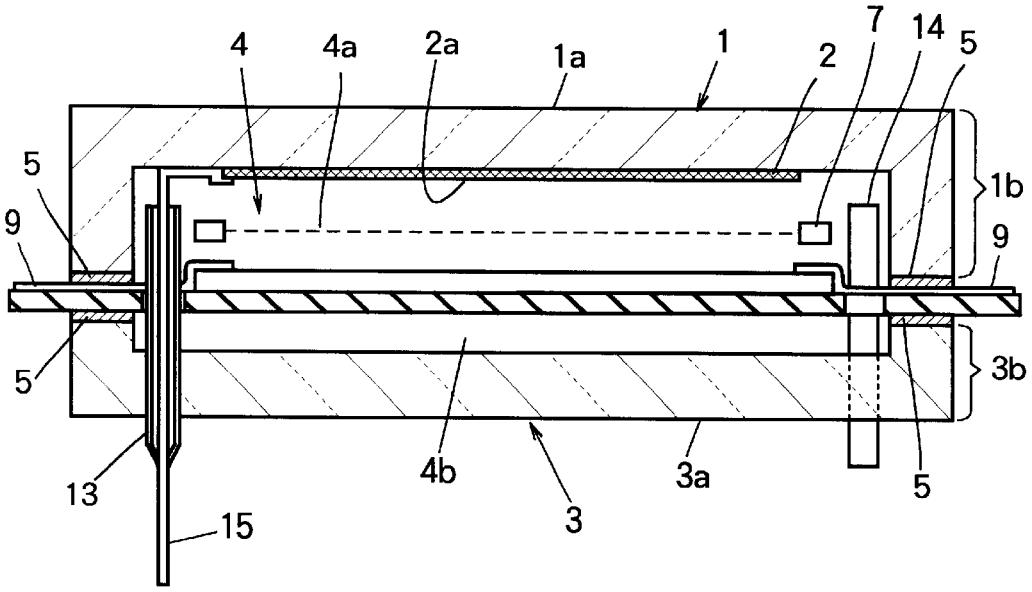
FIGS. 5A and 5B are respectively cross sectional and plan views of an image display device according to a fifth embodiment of the present invention.
Figure 5B:
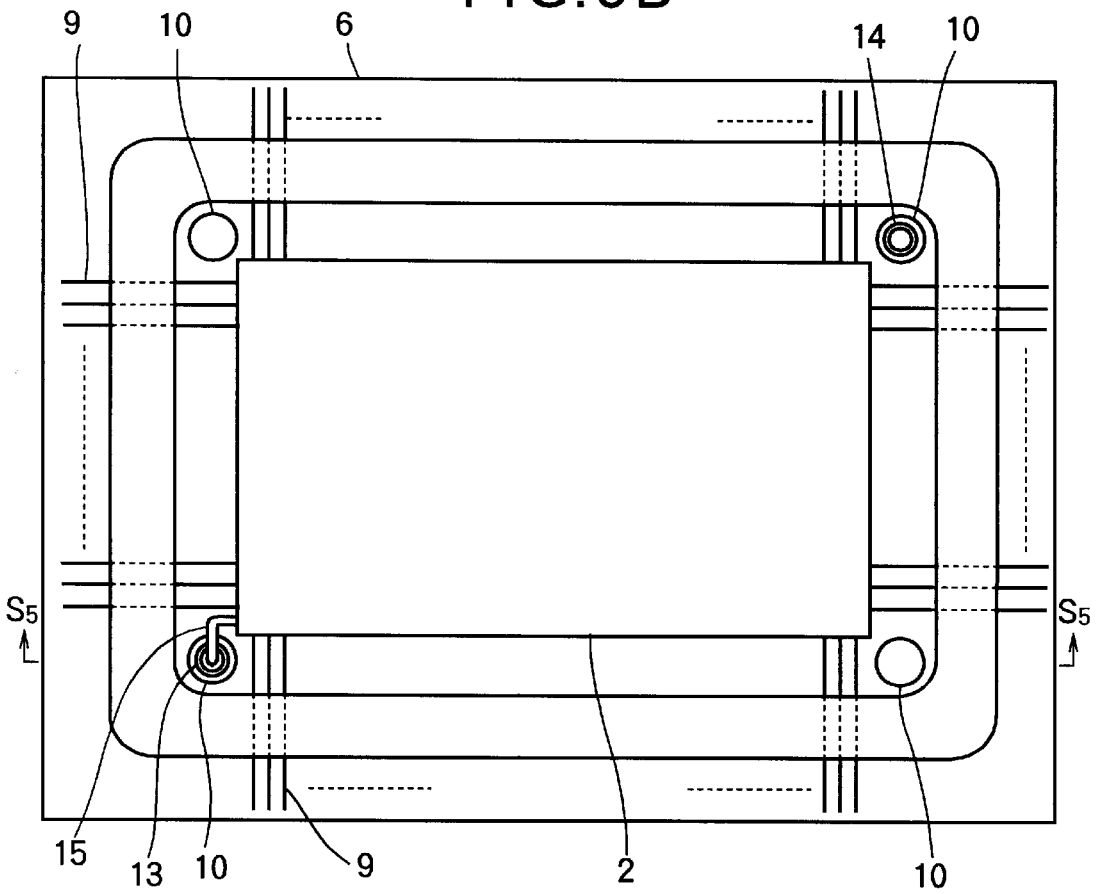

FIGS. 5A and 5B are respectively cross sectional and plan views schematically showing an image display device according to a fifth embodiment of the present invention. The cross section shown in FIG. 5A corresponds to the cross section taken along a line $S_5$—$S_5$ in FIG. 5B. Those structures in FIGS. 5A and 5B that are identical to or correspond to structures in FIGS. 2A and 2B are assigned identical symbols.

The image display device of the fifth embodiment has exhaust pipes 13 and 14 for communicating the front chamber 4*a* between the front glass case 1 and the cathode board 6 and the outside of the front glass case 1 and the rear case 3, and a lead wire 15 for applying a positive voltage to a metal back layer 2*a* disposed on the inner surface of the phosphor screen 2, which penetrates the inside of the exhaust pipe 13 to the outside of the front glass case 1 and the rear case 3. During a sealing process, the sealing is conducted while inert gases flows into the front chamber 4*a* through the through hole 14. Further, before the exhaust process, the lead wire 15 of the positive electrode and the exhaust pipe 13 are sealed.

In the fifth embodiment, since two exhaust pipes 13 and 14 are provided, by introducing inert gas such as nitrogen gas to the front chamber 4*a* at an adequate rate, oxidation of the cathode 41 (FIG. 13) can be prevented even if the temperature is 450° C. Furthermore, since the lead wire 15 of the positive voltage is disposed inside the exhaust pipe 13, voltage proof between the cathode 41 and the other electrode can be improved, thereby improving the reliability of the image display device. In addition, three exhaust pipes may be provided. Except for the above points, the fifth embodiment is the same as the second embodiment.

Sixth Embodiment

Figure 6A:
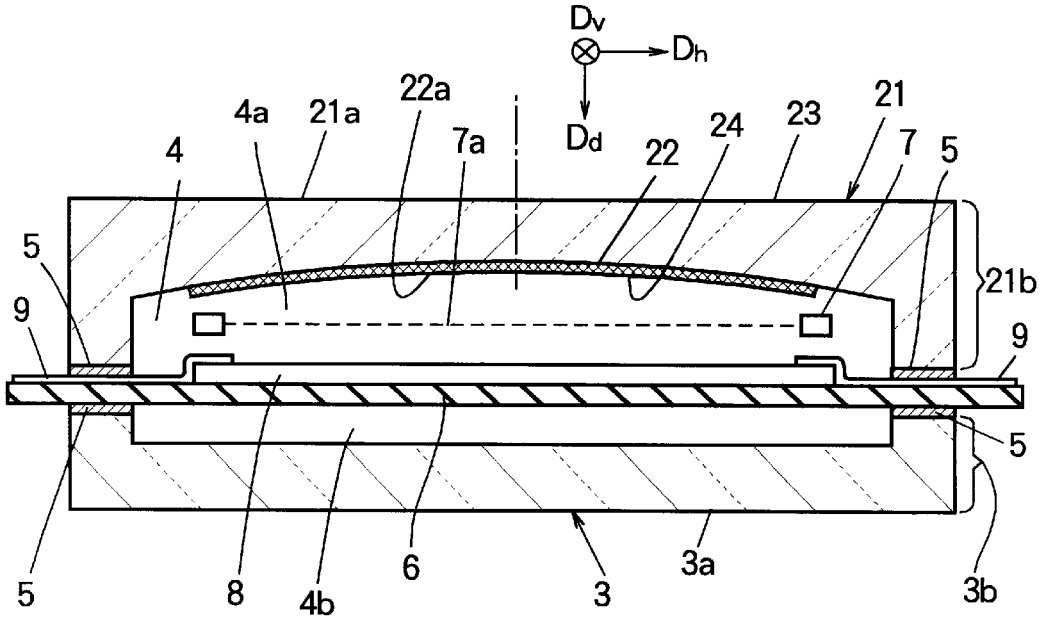
FIGS. 6A and 6B are respectively cross sectional and perspective views of an image display device according to a sixth embodiment of the present invention.
Figure 6B:
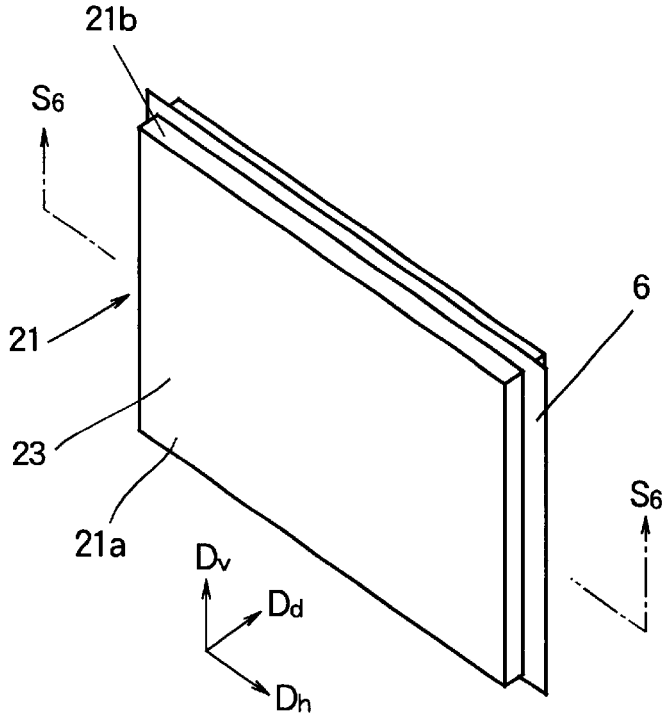

FIGS. 6A and 6B are respectively cross sectional and perspective views of an image display device according to a sixth embodiment of the present invention. The cross section shown in FIG. 6A corresponds to the cross section taken along a line $S_6$—$S_6$ in FIG. 6B. In FIGS. 6A and 6B, Dh denotes a horizontal direction parallel to a long side of the face portion 21*a* of the front glass case 21, Dv denotes a vertical direction parallel to a short side of the face portion 21*a* of the front glass case 21, and Dd denotes a depth direction perpendicular to an outer surface of the face portion 21*a* of the front glass case 21.

As shown in FIGS. 6A and 6B, the image display device of the sixth embodiment has a front glass case 21 provided with a phosphor screen 22 on an inner surface thereof, a rear case 3 facing the front glass case 21, and a sealing portion 5 with which the front glass case 21 and the rear case 3 are hermetically sealed so that an airtight chamber 4 is formed between the inner surface 24 of the front glass case 21 and an inner surface of the rear case 3. The front glass case 21 includes a face portion 21*a* on which the phosphor screen 22 is provided and a side wall 21*b* extending from the face portion 21*a* toward the rear case 3. The rear case 3 includes a rear portion 3*a* and a side wall 3*b* extending from the rear portion 3*a* toward the front glass case 21. The sealing portion 5 is formed between the side wall 21*b* of the front glass case 21 and the side wall 3*b* of the rear case 3.

Further, the image display device of the sixth embodiment has a cathode board 6 facing the phosphor screen 22 within the airtight chamber 4 and a collector electrode 7 provided between the cathode board 6 and the phosphor screen 22, for collecting electrons emitted from the cathodes. The collector electrode 7 is supported on the front glass case 21 or the cathode board 6, for instance. A cathode portion 8 of the cathode board 6 includes a plurality of cathodes 41 (shown in FIG. 13) facing the phosphor screen 22 for emitting electrons and a wiring pattern 9 for applying a voltage to the cathodes 41. The cathode 41 is, for instance, conical as shown in FIG. 13, and electron emitting is controlled by voltages of the cathode 41 and the gate electrode 44. A plurality of cathodes are orderly arranged in matrix form and correspond to the phosphor dots composing the phosphor surface 22. The cathodes of each color R, G or B are arranged in matrix of 480 rows and 640 columns, for instance.

In the above-described image display device of the sixth embodiment, electrons are emitted from the cathode 41 when a given negative voltage is applied to the cathode 41 and a given positive voltage is applied to the gate electrode 44. The emitted electrons are collected by electrostatic effect of the penetrating hole 7*a* of the collector electrode 7, and accelerated by high voltage (for instance, 10 kV) applied to the metal back layer 22*a* provided on an inner surface of the phosphor screen 22 on the side of the cathode board 6. The accelerated electrons with high energy strike the phosphor dots of the phosphor screen 22, causing the phosphor dots to emit light so that an image is displayed on the phosphor screen 22.

As shown in FIG. 6A, the face portion 21*a* of the front glass case 21 includes a substantially flat outer surface 23 facing a viewer and an inner surface 24 on which the phosphor screen 22 is coated. A cross section of the inner surface 24 taken along the direction of the vertical direction Dv is straight, and a cross section of the inner surface 24 taken along the horizontal direction Dh is concavely curved with a predetermined radius of curvature $R_x$.

The function of the face portion 21 having the flat outer surface 23 and the inner surface 24 concavely curved with the predetermined radius of curvature $R_x$ will next be described. Light advances straight in a homogenous medium. However, when light encounters a boundary between two different mediums, part of the light is reflected by the boundary, and the remaining part of the light is refracted and passes through the different medium. The same phenomenon occurs when an image displayed on the face portion 21*a* of the front glass case 2 is observed. Due to the difference between the refractive index of the atmosphere and that of glass, the displayed image is generally perceived as being floated near the edges of the phosphor screen.

Figure 7:
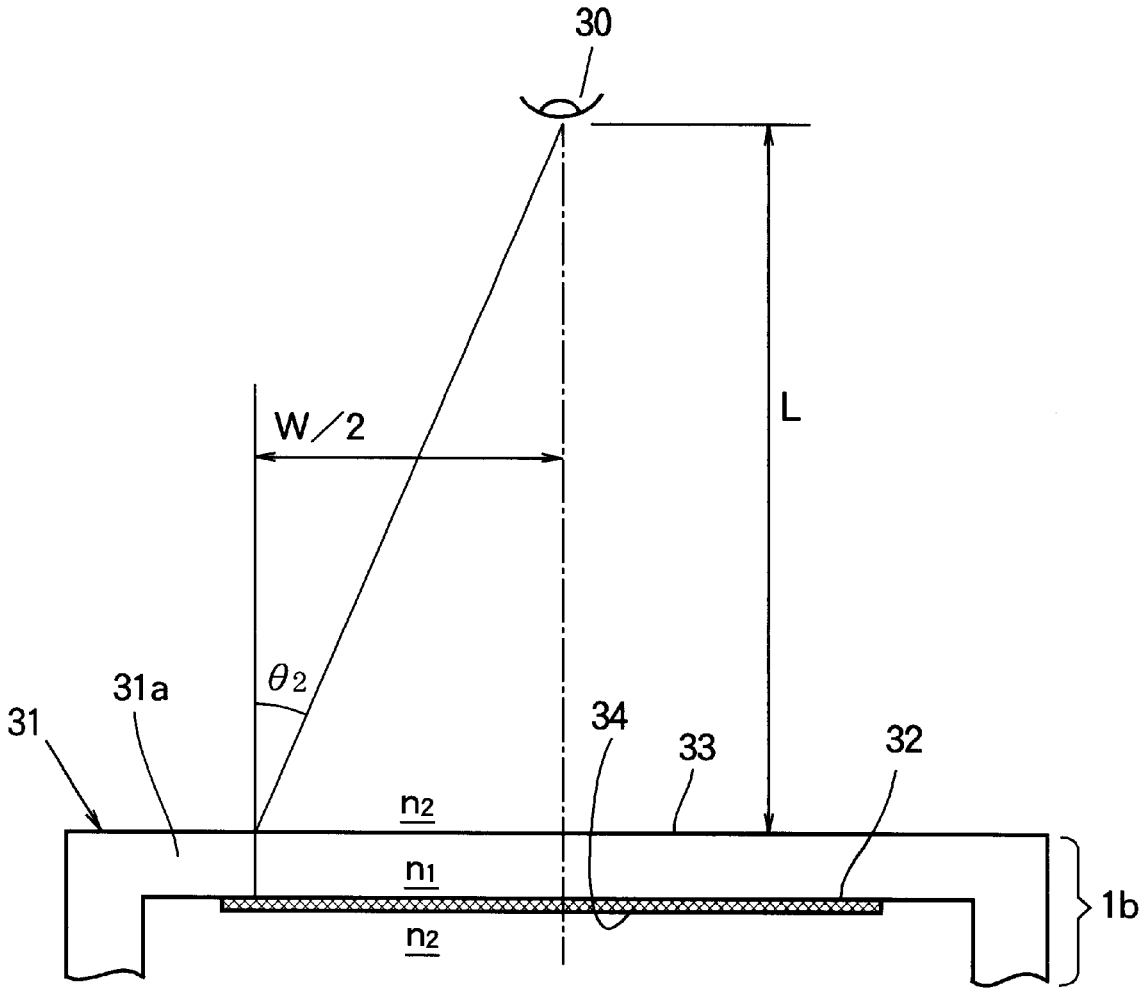
FIG. 7 CONVENTIONAL ART
FIG. 7 shows a cross section of an image display device with flat inner and outer surfaces for explaining a floating distance of an image.
Figure 8:
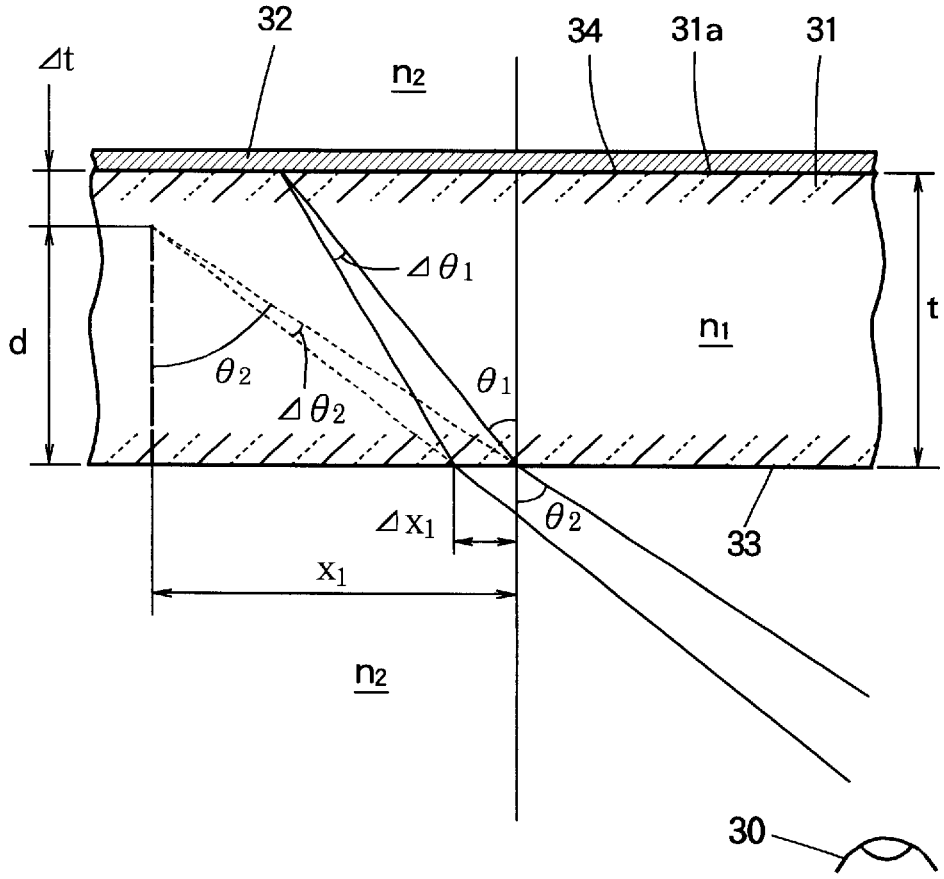
FIG. 8 is a diagram for explaining the floating distance Δt of the image on the face portion of the image display device shown in FIG. 7.

FIG. 7 shows a cross section of an image display device with flat inner and outer surfaces for explaining a floating distance (or floating distortion) of an image, and FIG. 8 is a diagram for explaining the floating distance Δt of the image on the face portion of the image display device shown in FIG. 7. With reference to FIG. 7 and FIG. 8, a phenomenon occurring in the image display device being actually used, which comprises a front glass case 31 having flat inner and outer surfaces 34 and 33 of the face portion will next be described. As illustrated in FIG. 7 and FIG. 8, light emitted from an image produced on the phosphor screen 32 advances straight in the glass of the front glass case 31 (a refractive index $n_1$) until it encounters the boundary (i.e., the outer surface 33) between the front glass case 31 and the atmosphere (a refractive index $n_2$). The light is refracted at the boundary and goes straight in the atmosphere to an eye 30 of a viewer, and then the image is recognized. The incident angle $\theta_1$ of the light from the image at the boundary between the atmosphere and the glass of the front glass case 31 depends on a position of the eye 30 of the viewer and a position on the display surface of the image display device (especially a distance between the center and the edge). Accordingly, an angle $\theta_2$ of refraction varies according to the positions, causing the displayed image to be perceived as being floated near the edges of the phosphor screen.

In FIG. 7 and FIG. 8, $n_1$ denotes the refractive index of the glass of the front glass case 31, $n_2$ denotes the refractive index of the atmosphere, $\theta_1$ denotes an incident angle of the light advancing from the phosphor screen 32 through the front glass case 31 to the atmosphere at a point on the boundary, and $\theta_2$ denotes an angle of refraction. Also, t denotes a thickness of the face portion 31*a* of the front glass case 31, Δt denotes a floating distance (or floating distortion) at the edges of the screen, and d denotes a depth of the image perceived by the viewer.

Referring to FIG. 7 and FIG. 8, the following relationship is obtained.

$$d * \tan\theta_2 = x_1$$

$$d * \Delta\theta_2 * \frac{1}{\cos^2\theta_2} = \Delta x_1$$

$$d = \frac{\Delta x_1}{\Delta\theta_2}\cos^2\theta_2 = -\frac{1}{\Delta\theta_2}\cos^2\theta_2\frac{x_1}{\cos\theta_1\sin\theta_1}\Delta\theta_1$$

On the other hand, the following conditions are satisfied, because the refractive index of the air is 1.

$n_1 \sin\theta_1 = n_2 \sin\theta_2$ $n_2 = 1$

Accordingly, $$d = \frac{1}{n_1}\frac{1+\cos^2\theta_2}{\sin^2\theta_2}x_1 = \frac{t}{n_1}\frac{\cos^2\theta_2}{1-\left(\frac{1}{n_1}*\sin\theta_2\right)^2}$$

Therefore, the following relationship is obtained:

$$\Delta t = t - d = t*\left(1-\frac{1}{n_1}\frac{\cos^2\theta_2}{1-\left(\frac{1}{n_1}*\sin\theta_2\right)^2}\right) = t*\left(1-\frac{\cos^2\theta_2}{n_1-\frac{1}{n_1}*\sin^2\theta_2}\right)$$

Using this relationship, the floating distance Δt at each location of the face portion (for example, at each location on the horizontal axis) of the image display device of FIG. 6A is calculated. The inner surface 24 of the face portion 21*a* of the image display device is formed so as to have the horizontal radius of curvature $R_x$ calculated by the floating distance Δt at each location of the face portion. In other words, the horizontal radius of curvature $R_x$ of the inner surface 24 of the face portion 21*a* is determined in accordance with the floating distance Δt at each location of the face portion 21*a*. The inner surface 24 of the face portion 21*a* is formed to be concave in the direction of the horizontal direction (so that the distance between the inner surface 24 and outer surface 23 of the face portion 21*a* increases as it goes closer to the edge) in such a way that the produced image is not perceived as being concave but as being visually flat.

Because human eyes are horizontally aligned, a depth is perceived by processing mainly horizontal information and it is hard to obtain the information of depth from vertical information. So, the floating distance in a vertical direction gives little effect on the perceived flatness of the image. Due to the above-mentioned function, by forming the inner surface 24 to have the curvature only in the horizontal direction, as shown in FIG. 6A, the displayed image is visually perceived as being flat. Further, the inner surface 24 of the face portion 21*a* may have the curvature in the vertical and/or diagonal direction.

When the image display device of which the effective area of picture has a horizontal width W is viewed at a distance L in its actual use status, as shown in FIG. 7, the floating distance Δt at the edges of the face portion of the image display device is expressed as indicated below:

$$\theta_2 = \tan^{-1}\left(\frac{W}{2*L}\right)$$

$$\Delta t = t*\left[1-\frac{\cos^2\theta_2}{n_1-\frac{1}{n_1}*\sin^2\theta_2}\right]$$

Accordingly, when the floating distance Δt is compensated for by setting the radius of curvature $R_x$ of the inner surface 24 of the face portion 21*a* of the front glass case 21 in the horizontal shown in FIG. 6 (so that the distance between the inner surface 24 of the face portion 21*a* of the front glass case 21 and the outer surface 23 of the face portion 21*a* increases as it goes closer to the edges), the image is not perceived as being concave even if the face portion 21*a* of the front glass case 21 has the flat outer surface 23. As a result, the produced image is visually perceived as being flat.

The horizontal radius of curvature $R_x$ of the inner surface 24 of the face portion 21*a* is expressed as the following approximation so that the produced image is perceived as being flat:

$$R_x = \frac{\left(\frac{W}{2}\right)^2 + \Delta t^2}{2 * \Delta t}$$

However, since the image surface of the conventional image display device is convexly curved, the convexly curved image may often be preferred. Accordingly, it is desirable that the following conditions (1), (2) and (3) are satisfied:

$$R_x \leq \frac{\left(\frac{W}{2}\right)^2 + \Delta t^2}{2 * \Delta t} \quad (1)$$

$$\Delta t = t * \left[1 - \frac{\cos^2\theta_2}{n_1 - \frac{1}{n_1} * \sin^2\theta_2}\right] \quad (2)$$

$$\theta_2 = \tan^{-1}\left(\frac{W}{2 * L}\right) \quad (3)$$

where t denotes the thickness of the glass at the center of the screen.

The standard optimum viewing distance L used for the image display devices is generally up to about 500 mm even when they are used as display monitors. The radius of curvature $R_x$ of the inner surface 24 of the face portion 21*a* of the front glass case 21 in the direction of the horizontal axis H should be set as indicated below:

$$R_x \leq \frac{\left(\frac{W}{2}\right)^2 + \Delta t^2}{2 * \Delta t}$$

$$\Delta t = t * \left[1 - \frac{\cos^2\theta_2}{n_1 - \frac{1}{n_1} * \sin^2\theta_2}\right]$$

$$\theta_2 = \tan^{-1}\left(\frac{W}{2 * 500}\right)$$

The optimum viewing distance L for the image display devices used in general televisions sets is about 5*h, where h is the screen height (vertical width of the effective area of picture). Accordingly, the image can be perceived as being flat by setting $R_x$ approximately as indicated below:

$$R_x \leq \frac{\left(\frac{W}{2}\right)^2 + \Delta t^2}{2 * \Delta t}$$

$$\Delta t = t * \left[1 - \frac{\cos^2\theta_2}{n_1 - \frac{1}{n_1} * \sin^2\theta_2}\right]$$

$$\theta_2 = \tan^{-1}\left(\frac{W}{2 * 5 * h}\right)$$

With the front glass case 21 having a geometrically flat outer surface 23 of the face portion 21*a* and an inner surface 24 of the face portion 21*a* curved with such radius of curvature calculated to produce an image perceived as being flat, allowing for the difference between the refractive index of the atmosphere and that of the panel glass, an image that is perceived as being really flat can be displayed.

Seventh Embodiment

Figure 9:
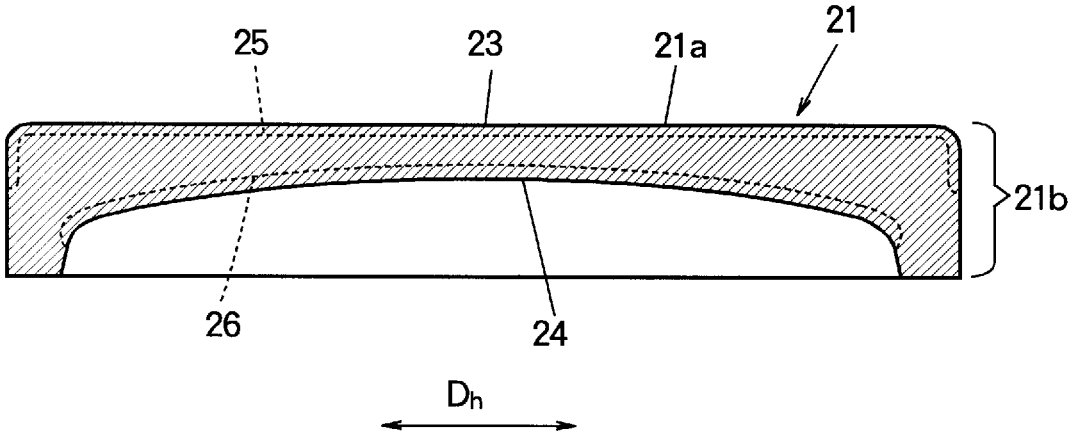
FIG. 9 is a cross sectional view showing an image display device taken along a horizontal direction according to a seventh embodiment of the present invention.

FIG. 9 is a cross sectional view showing an image display device taken along a horizontal direction according to a seventh embodiment of the present invention. The image display device according to the seventh embodiment is the same as that according to the sixth embodiment with the exception that compressive stress layers are formed under the outer and inner surfaces 23 and 24 of the face portion 21*a* of the front glass case 21. The thickness of the compressive stress layers 25 and 26 is not less than $t_c/10$, where $t_c$ denotes a thickness of the face portion 21*a* of the front glass case 21 at the center.

The compressive stress layers 25 and 26 are formed by press-forming the front glass case 21 from molten glass and cooling it slowly in an annealing furnace so as to be physically reinforced. Magnitude of stress generated by this process depends on a time needed to gradually lower a temperature of the surfaces of the front glass case 21 from the annealing temperature to the strain point. As a cooling rate increases, a difference between surface shrinkage and central shrinkage increases, increasing the compressive stress on the surfaces after the cooling process. The compressive stress layers 25 and 26 enhances mechanical strength of the surfaces of the front glass case 21. Actual implosion resistance tests and the like have proved that if a stress value $\sigma_c$ is below 1000 psi, the compressive stress layers 25 and 26 do not contribute physical reinforcement, while if the stress value $\sigma_c$ exceeds 2000 psi, the surface of the front glass case 21 is flaked off when it receives a mechanical impact. Therefore, a desired range of $\sigma_c$ is:

$$1000 \text{ psi} \leqq \sigma_c \leqq 2000 \text{ psi}$$

The front glass case 21 is used as a vacuum vessel. The atmospheric pressure applied to the outer surface of the front glass case 21 therefore generates stress. The front glass case 21 is not spherical but has an asymmetrical structure, which results in comparatively wide areas of compressive stress and tensile stress. It is well known that a local crack or failure made by a mechanical impact is instantly extended to free the stored strain energy, resulting in implosion.

The front glass case 21 of which face portion has the flat outer surface 23 has lower resistance to the mechanical impact. The front glass case 21 of which face portion has the flat outer surface 23, however, can maintain predetermined mechanical strength when the compressive stress layers 25 and 26 for the physical reinforcement are provided as in this embodiment.

Eighth Embodiment

In the front glass case 21 of which face portion 21*a* has the flat outer surface 23 and the curved inner surface 24, as described in the sixth and seventh embodiments, the thickness of the front glass case 21 at the center of the face portion 21*a* widely differs from that at the edges of the face portion 21*a*, resulting in a difference in light transmittance. Accordingly, in the image displayed on the phosphor screen, the light transmittance at the center differs from that at the edges, resulting in variety of brightness throughout the screen. Especially, a difference between the brightness at the center and that at the edges significantly affects a perceived depth of the image, which affects the perceived flatness of the image.

Figure 10:
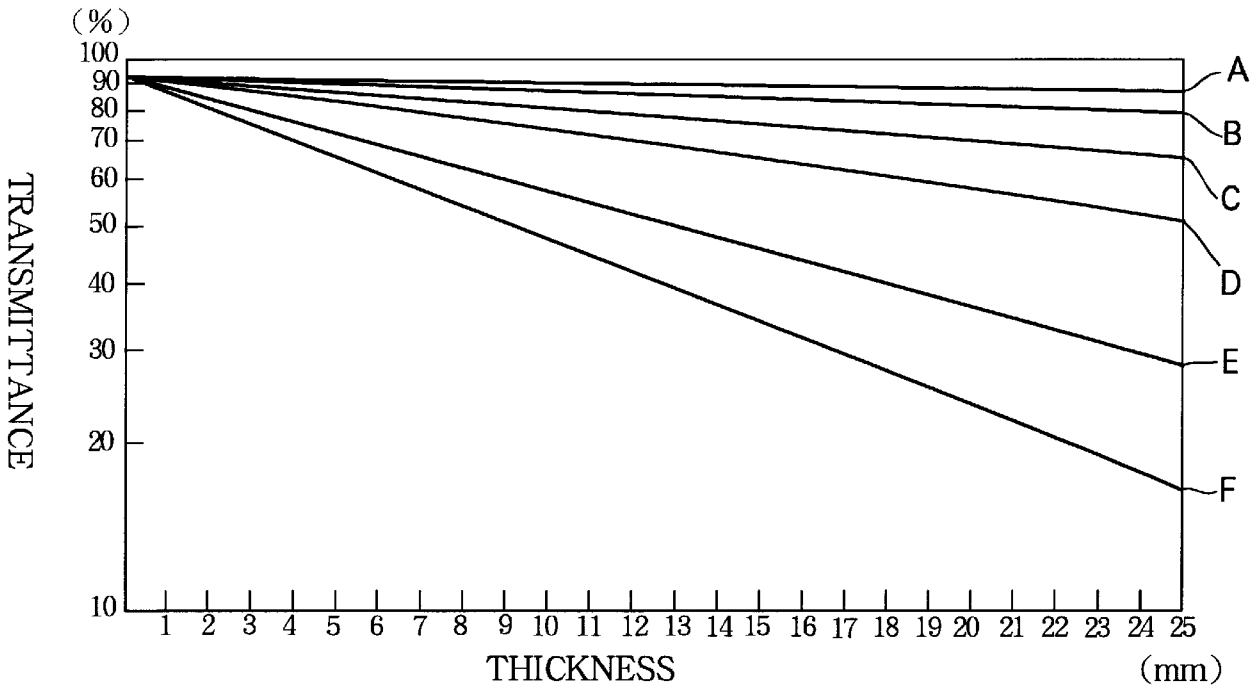
FIG. 10 shows transmittance characteristics of glass materials of the face portion of the image display device according to an eighth embodiment of the present invention.

The glass materials currently used for image display devices include A, B, C, D, E and F shown in FIG. 10. A plate of glass material E, which is used for most panels, shows a transmittance of about 52% when the thickness is 12 mm. If the inner surface of the panel made from this material is curved to increase its thickness by 4 mm at the edges, for example, the transmittance at the edges is about 43%. The ratio of transmittance at the center to that at the edges is therefore about 100:82. As a result, uniformity in brightness throughout the whole screen is deteriorated.

The deterioration of uniformity in brightness, or the difference between the brightness at the center and that at the edges, due to the difference between the thickness of the glass plate at the center and that at the edges can be reduced by increasing the transmittance of the glass material used for the panel. In the commercially available glass panels, a ratio of brightness at the edges to that at the center of the screen is currently 85% or higher. A glass material having such transmittance that brings the ratio of the brightness at the edges to that at the center of the screen to 85% or higher should be used for the glass plate in which the thickness at the edges is greater than that at the center.

Generally, the transmittance T% of glass is defined as follows:

$$T=(1-R)^2*e^{kt}*100$$

where R denotes a reflectivity of the glass, k denotes an absorption coefficient, and t is the thickness of the glass. Therefore, a glass material that satisfies the following condition should be used:

$$\frac{(1-R)^2*e^{kt_1}*100}{(1-R)^2*e^{kt_0}*100} \geq 0.85$$

where $t_0$ denotes a thickness of the face portion 21*a* at the center of the screen, and $t_1$ denotes a thickness of the face portion 21*a* at the edges of the screen. If a glass material characterized by R=0.045 and k=0.00578 is used, for example, a glass plate which is 12 mm thick at the center and 16 mm thick at the edges can satisfy the condition indicated above.

As described above, the panel of which face portion has the flat outer surface and the curved inner surface has the difference between the transmittance at the center and that at the edges, which is caused by the variation in the thickness of the glass. By forming the front glass case 21 from the glass material with a high transmittance that satisfies the condition indicated above, the effect of the variation in the thickness can be reduced and the difference in the transmittance is almost eliminated throughout the screen.

Except for the above points, the image display device according to the eighth embodiment is the same as that according to the sixth embodiment.

Ninth Embodiment

Using a glass material with a high transmittance for the panel causes reflection of external light on the phosphor screen to increase, thereby degrading the contrast, which is an important characteristic of the image display devices. The image display device formed as has been described in the third embodiment can keep the difference between the brightness at the center and that at the edges within a permissible range if the panel has a transmittance of 60% or higher. This image display device, however, has low contrast.

Figure 11:
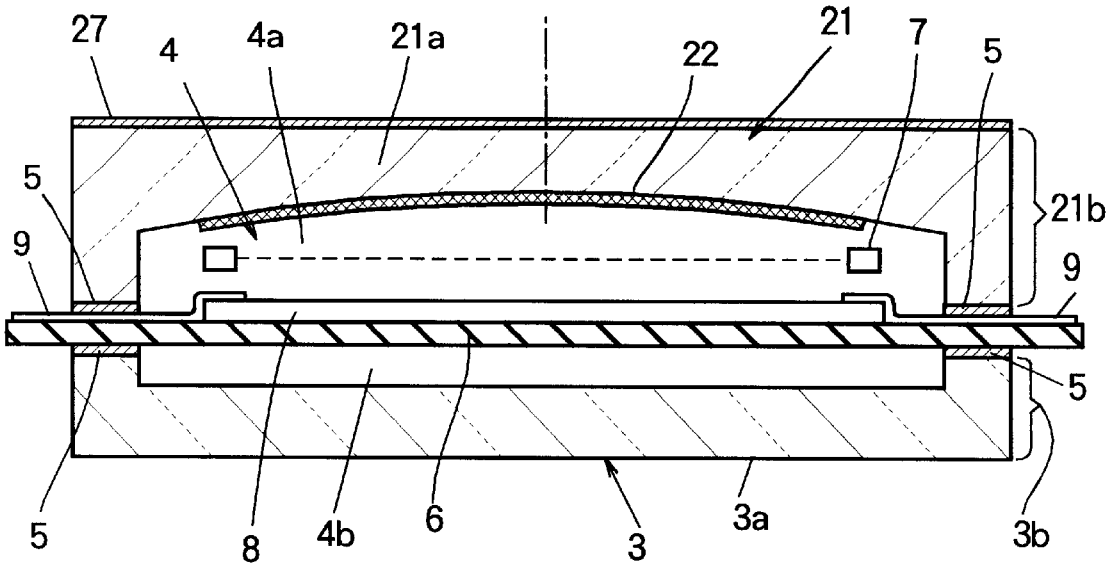
FIG. 11 is a cross sectional view showing an image display device according to a ninth embodiment of the present invention.
Figure 12:
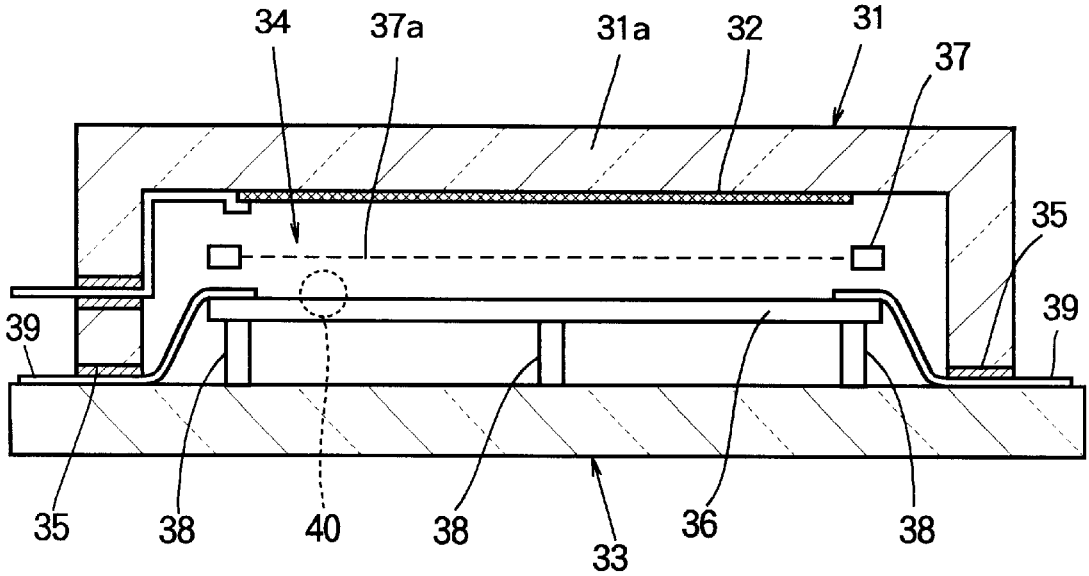
FIG.12 CONVENTIONAL ART
FIG. 12 is a cross sectional view showing a conventional image display device.

Generally, the image display device formed as has been described in the first embodiment must have a transmittance of 60% or above, when the screen size and the viewing distance are taken into consideration. On the other hand, sufficient contrast can be maintained when the transmittance of the panel ranges from 30% to 60%. Therefore, an overall transmittance can be kept within the range of 30% to 60% and sufficient contrast can be maintained by using a glass material with a transmittance of 60% or above and providing the surface of the front glass case 21 with a surface treatment film 27 having a transmittance of about 50% to 90%, as shown in FIG. 11.

The surface treatment film 27 on the front glass case 21 can be performed by the following methods: a film adhesion method in which a base film provided with a light absorption layer, antistatic layer, antireflection layer and the like is disposed on the surface of the front glass case 21 of the image display device; a wet coating method in which a light absorption layer and the like are formed by coating the surface of the front glass case 21 of the image display device with a liquid mixture of an organic or inorganic base coat and an organic or inorganic pigment or dye, through spin coating or spraying; and a dry coating method in which a light absorption layer and the like are directly deposited on the surface of the front glass case 21 of the image display device by coating through vacuum evaporation and the like.

As has been described above, if the material with the high transmittance is used for the panel, the contrast would be degraded, but the contrast is improved by optimizing the overall transmittance through the surface treatment film 27. Accordingly, the image display device that reproduces a high quality image which is perceived as being flat without difference in brightness can be provided.

Further, the surface treatment film 27 can also be provided on the image display device according to the first, second or third embodiment.

The invention being thus described, it will be obvious that the same may be varied in many ways. Such variations are not to be regarded as a departure from the spirit and scope of the invention, and all such modifications as would be obvious to one skilled in the art are intended to be included within the scope of following claims.

What is claimed is:

1. An image display device comprising:

a front case provided with a phosphor screen on an inner surface thereof;

a rear case facing said front case;

a sealing portion hermetically sealing said front case and said rear case so that an airtight chamber is formed between said inner surface of said front case and an inner surface of said rear case; and a cathode board including a cathode which is disposed within the airtight chamber and faces the phosphor screen, and a wiring pattern for applying a voltage to the cathode;

wherein said cathode board is held between said front case and said rear case by said sealing portion so that said cathode board is not in contact with the inner surface of said front case or the inner surface of said rear case.

2. The image display device of claim 1, wherein:

said front case includes a face portion on which the phosphor screen is provided and a side wall extending from said face portion toward said rear case;

said rear case includes a rear portion and a side wall extending from said rear portion toward said front case; and said sealing portion is formed between said side wall of said front case and said side wall of said rear case.

3. The image display device of claim 1, wherein said cathode board extends outside said airtight chamber.

4. The image display device of claim 1, wherein said cathode board has a through hole through which a front chamber formed between said front case and said cathode board communicates with a rear chamber formed between said rear case and said cathode board.

5. The image display device of claim 4, further comprising a getter for absorbing impurities, said getter being disposed in said rear chamber.

6. The image display device of claim 4, further comprising:

an exhaust pipe which penetrates the through hole and the rear case so that the front chamber communicates with outside of said front case and said rear case.

7. The image display device of claim 6, wherein said cathode board has a second through hole through which said front chamber communicates with said rear chamber;

said image display device further comprising:

a second exhaust pipe which penetrates said second through hole and said rear case so that said front chamber communicates with the outside of said front case and said rear case;

a metal back layer disposed on an inner surface of said phosphor screen; and a lead wire for applying a positive voltage to said metal back layer, said lead wire penetrating said second exhaust pipe.

8. The image display device of claim 1, wherein:

said front case includes a face portion having a substantially flat outer surface facing a viewer and the inner surface on which the phosphor screen is coated; and said inner surface of said face portion is concavely curved with a radius of curvature $R_x$ in a horizontal direction parallel to a side of said face portion, and the following conditions, (1), (2), and (3) are satisfied:

$$R_x \leq \frac{\left(\frac{W}{2}\right)^2 + \Delta t^2}{2 * \Delta t} \tag{1}$$

$$\Delta t = t * \left[1 - \frac{\cos^2\theta_2}{n_1 - \frac{1}{n_1} * \sin^2\theta_2}\right] \tag{2}$$

$$\theta_2 = \tan^{-1}\left(\frac{W}{2 * L}\right) \tag{3}$$

where W denotes a horizontal width of an effective picture area in said face portion, L denotes an optimum viewing distance, $n_1$ denotes a refractive index of said face portion, and t denotes a thickness of said face portion at a center thereof.

9. The image display device of claim 8, wherein said face portion includes compressive stress layers respectively formed under said outer surface and said inner surface thereof.

10. The image display device of claim 9, wherein a condition 1000 psi$\leqq\sigma_c\leqq$2000 psi is satisfied, where $\sigma_c$ denotes a value of stress generated in said compressive stress layers.

11. The image display device of claim 1, wherein said front case includes a face portion made of glass material, and the glass material of said face portion satisfies the equation:

$$\frac{(1-R)^2 * e^{kt_1} * 100}{(1-R)^2 * e^{kt_0} * 100} \geq 0.85$$

where R denotes a reflectivity of the glass material, k denotes an absorption coefficient of the glass material, $t_0$ denotes a thickness of said face portion at a center thereof, and $t_1$ denotes a thickness of said face portion at an edge thereof.

12. The image display device of claim 11, further comprising:

a surface treatment film having a transmittance ranging from about 50% to 90% on said face portion, the glass material of said face portion having a transmittance of 60% or higher, so that an overall transmittance of said face portion and said surface treatment film ranges from 30% to 60%.

13. The image display device of claim 3, wherein said cathode board extends outside said airtight chamber through said sealing portion.

14. The image display device of claim 13, wherein said wiring pattern included on said cathode board extends outside said airtight chamber through said sealing portion.

* * * * *